United States Patent [19]

Shiina et al.

[11] Patent Number: 5,010,605

[45] Date of Patent: Apr. 30, 1991

[54] BODY MASSAGING APPARATUS OF WATER CURRENT TYPE

[75] Inventors: Toshio Shiina, Kawasaki; Keiko Miyamoto, Yokohama; Kouji Izumi, Yokohama; Yasuro Hayashi, Yokohama; Yonenobu Karasawa, Numazu; Satoru Uematsu, Numazu; Naoki Sei, Numazu, all of Japan

[73] Assignee: Ricoh Company, Ltd., Tokyo, Japan

[21] Appl. No.: 335,734

[22] Filed: Apr. 10, 1989

[30] Foreign Application Priority Data

| | | | |
|---|---|---|---|
| Apr. 13, 1988 | [JP] | Japan | 63-90814 |
| Apr. 13, 1988 | [JP] | Japan | 63-90815 |
| Jan. 24, 1989 | [JP] | Japan | 1-14800 |

[51] Int. Cl.[5] ..... A61H 33/02

[52] U.S. Cl. ..... 4/542; 4/488

[58] Field of Search ..... 4/491, 492, 507, 509, 4/541-544, 573, 575, 488

[56] References Cited

U.S. PATENT DOCUMENTS

| | | | |
|---|---|---|---|
| 3,295,146 | 1/1967 | Martin et al. | 4/575 |
| 3,797,482 | 3/1974 | Nicollet | 4/541 X |
| 4,602,391 | 7/1986 | Shepherd | 4/542 |

FOREIGN PATENT DOCUMENTS

| | | | |
|---|---|---|---|
| 25804 | 8/1963 | German Democratic Rep. | 4/491 |
| 61-90661 | 5/1986 | Japan . | |
| 61-174928 | 10/1986 | Japan . | |
| 61-240958 | 10/1986 | Japan . | |
| 62-30826 | 2/1987 | Japan . | |
| 0658373 | 11/1986 | Switzerland | 4/575 |
| 8800037 | 1/1988 | World Int. Prop. O. | 4/575 |

OTHER PUBLICATIONS

"Study on Aquafitness," Monthly Leisure Industry, Data No. 230, pp. 150-153, published Feb. 1, 1987.

*Primary Examiner*—Charles E. Phillips

*Attorney, Agent, or Firm*—Cooper & Dunham

[57] ABSTRACT

A body massaging apparatus of a circulated water current type to be used for lean figure beauty, comprises bathtub for storing therein water and accomodating therein at least one patient in a state close to a lying attitude with the face upward. The bathtub is formed with an inlet opening for introducing the water into the bathtub and an outlet opening for discharging the water from the bathtub. The inlet opening is positioned to confront the back of the patient's body, while the outlet opening is positioned opposite to the inlet opening. A circulating conduit for circulating the water through the bathub is disposed outside of the bathtub and connects the outlet opening with the inlet opening. A uniform current generator is provided in place in the circulating conduit to generate in the bathtub a uniform water current which flows in one direction from the inlet opening toward the outlet opening and is applied directly to the patient's back substantially in parallel to or at an acute angle to the longitudinal axis of the patient's body.

12 Claims, 5 Drawing Sheets

BODY MASSAGING APPARATUS OF WATER CURRENT TYPE

BACKGROUND OF THE INVENTION

The present invention relates generally to a body massaging apparatus of a circulated water current type. More particularly, the invention relates to a body massaging apparatus of a circulated water current type for providing a vibratory stimulating or massaging effect on the surface of a human's body, particularly on the surface of the human's abdomen, by means of a fluid force so as to enhance metabolism the body and make firmer or leaner.

Body massaging apparatuses of a circulated water current type which combine, in view of medical science and physiology, a living body and fluid dynamics to employ the influence of vibratory stimulation on the body surface by a water flow, have been developed. Such apparatuses are disclosed in, for example, Japanese Unexamined Patent Publication Nos. 61-90661, 61-240958, Japanese Unexamined Utility Model Publication No. 61-17492, and a report entitled "STUDY ON AQUAFITNESS", on pages 150 to 153 of a Monthly journal "LEISURE INDUSTRY", Data No. 230. These apparatuses produce around a patient placed in a bathtub a water current directly and continuously acting on the front of the patient's body such that the water current flows in a direction generally perpendicular to the longitudinal axis of the body. More specifically, when the velocity of fluid in which a body is placed exceeds a certain value, Kármán vortices are produced therein to thereby vibrate the body right and left. In this case, if the body is made of a soft elastic material, the fluids having flowed along the surface of the body become unstable and the pressures exerted on the respective portions of the body surface change accordingly. The apparatuses disclosed in the references utilize such phenomena. Accordingly, these apparatuses produce a vibratory stimulating or massaging effect on the human's body, as shown by the results of experiments disclosed in the above-cited references.

In the apparatus of the above-mentioned type, however, the water current flows in a direction substantially perpendicular to the longitudinal axis of the patient's body, with the patient placed in the bathtub in substantially a standing attitude. In this case, when the apparatus is used to reduce excessive fat in the body surface layer, particularly in a region about the abdomen of an overweight patient, the patient placed in the bathtub in substantially a standing posture can not be fully relaxed, and thus, the body portions, particularly the region about the abdomen, a while receiving the massaging action of the water current. As a result, the metabolism of the patient's body, particularly in the region about the abdomen including the excessive fat, may not be effectively activated, and thus, the weight of the body, particularly in the region about the abdomen may not be reduced sufficiently. Accordingly, frequent baths have been required for achieving sufficient effects. For example, some patients using the above-described apparatus have been required to receive repeatedly massaging treatments of at least about thirty times to obtain a weight reduction of about 1.5 to 4.5 kg.

SUMMARY OF THE INVENTION

It is therefore an object of the present invention to provide a body massaging apparatus of a circulated water current type which can reduce effectively an excessive fat in a patient's body portion about the patient's abdomen to thereby recover a well-proportioned body in a short time without causing any excessive load on the patient's body.

It is another object of the present invention to provide a body massaging apparatus of a circulated water current type which can apply a vibratory stimulating or massaging effect not only to the patient's body portion about the patient's abdomen but also the patient's back.

According to one aspect of the present invention, there is provided a body massaging apparatus of a circulated water current type comprising: a bathtub for storing therein water and accommodating therein at least one patient in a state close to a lying attitude with the face upward, the bathtub being formed with an inlet opening for introducing the water into the bathtub and with an outlet opening for discharging the water from the bathtub, the inlet opening being positioned to confront the patient's back and the outlet opening being positioned opposite to the inlet opening; a circulating conduit disposed outside of the bathtub and connecting the outlet opening with the inlet opening; and a uniform current generator for generating in the bathtub a uniform water current which flows in one direction from the inlet opening toward the outlet opening and is applied directly on the surface of the body from the patient's back substantially in parallel to or at an acute angle to the longitudinal axis of the body, the uniform current generator being provided in the circulating conduit.

In the apparatus having the above-mentioned construction, the patient can be placed in a completely relaxed state in the uniform water current in the bathtub, with the patient's abdomen relaxed. Accordingly, activation of metabolism of the body can be accelerated. Further, the uniform water current is applied directly to the patient's body from the back of the body substantially in parallel to or at an acute angle to the longitudinal axis of the body. Accordingly, the patient's body portion, particularly in a region about the patient's abdomen, is effectively vibrated due to the generation of Kármán vortices. As the result, an excessive fat in the body portion about the patient's abdomen can be effectively reduced in a short time without causing any excessive load on the body, thereby recovering a well-proportioned body of the patient in a short time.

According to another aspect of the present invention, the above-mentioned body massaging apparatus further comprises a pulsating jet generator for injecting intermitently a pulsating water jet from the inlet opening toward into the bathtub so that the pulsating water jet is applied directly to the patient's back.

In the apparatus having the above-mentioned construction, the pulsating water jet injected into the bathtub from the inlet opening can apply effective vibration to the patient's back which is relatively hard. Accordingly, it is possible to apply a vibratory stimulating or massaging effect not only to the portion about the patient's abdomen but also the patient's back, achieving the whole curative effect for recovering a well-proportioned body of the patient in a short time.

Preferably the outlet opening has an upper end which is positioned below an average water level in the bathtub. In this construction, it is possible to prevent air from being drawn into the conduit through the outlet opening even when the water level in the bathtub changes within normal ranges. Accordingly, disadvantages caused by air mixing can be eliminated.

Preferably, the inlet and outlet openings have cross-sectional areas, respectively, in which the cross-sectional area of the outlet opening is larger than that of the inlet opening. This construction can prevent generation of an excessive suction force in the outlet opening due to negative pressure in the outlet opening. Accordingly, the patient is prevented from being pulled toward or into the outlet opening.

Preferably, the bathtub has opposite side walls each extending along the direction of flow of the water in the bathtub and each of which is formed with curved portion convexed outwardly in the vicinity of the inlet opening. These curved portion can increase the velocity of flow of the water passing between the side walls and the patient's body, proving a more effective vibration effect on the patient's abdomen.

Preferably, the pulsating jet generator comprises at least a pair of injection nozzles disposed near opposite lateral sides of the inlet opening of the bathtub, respectively, and which are capable of being so controlled as to inject the pulsating water jet alternately from the lateral sides of the inlet opening or from upper or lower sides of the inlet opening, each of the injecting nozzles being capable of changing an injection angle thereof in a vertical and/or horizontal direction. This construction can provide a beating effect on the patient's back. Further, the so treated region of the patient's back can be selected.

Preferably, the pulsating jet generator comprises an inlet port connected to the circulating conduit, for introducing therein the water to be injected into the bathtub. In this construction, suction pressure of the pulsating jet generator can be stabilized.

Preferably, the pulsating jet generator comprises an adjusting valve for adjusting an output pressure of the pulsating water jet injected from the pulsating jet generator. In this construction, an optimum stimulation effect due to the pulsating water jet is adjustable in accordance with respective paients.

Preferably, the body massaging apparatus further comprises a water current control unit for controlling the uniform current generator and the pulsating jet generator so as to activate only the pulsating jet generator for a predetermined first time after the operation of the body massaging apparatus has been started, activate at least the uniform current generator for a predetermined second time after an elapse of the first time, and, then, activate only the pulsating jet generator for a third predetermined time. According to this construction, the patient can always receive a massaging treatment in a well relaxed state.

Preferably, the body massaging apparatus further comprises a temperature contol unit for controlling the temperature of the water in the bathtub so as to set the water to a predetermined first temperature lower than the patient's temperature for a predetermined time immediately after the operation of the body massaging apparatus has been started, and raise gradually the water temperature to a predetermined second temperature which is higher than the patient's temperature. According to this construction, the patient can receive a massaging treatment with a pleasing effect without feeling fatigue or disagreeable sensation.

Preferably, the bathtub is provided with at least one fan for sending air to a region about the patient's head. This construction can prevent the patient from feeling a disagreeable sensation due to a high water temperature.

Preferably, the bathtub is provided with a pillow member for supporting thereon the back of the patient's head and neck.

Preferably, the pillow member has an upper surface and a lower end portion which is positioned below an average water level in the bathtub, the lower end of the pillow member being formed with a rounded notch for accomodating the back of the patient's neck, at least a part of the upper surface of the pillow member being concave so as to accomodate the back of the patient's head. More preferably, the pillow member is capable of being slidingly moved horizontally along the longitudinal axis of the patient. This construction can serve to place the patient in the bathtub in a relaxed state.

Preferably, the bathtub is provided with at least one support member for supporting thereon the patient's legs or hips, the support member being positioned below an average water level in the bathtub and extending horizontally across the direction of flow of the water. More preferably, the support member is formed with a plain surface extending in the longitudinal direction thereof, for laying thereon the legs or the hips of the patient. These construction also serve to place the patient in the bathtub in a relaxed state.

Preferably, the body massaging apparatus further comprises a detecting means arranged above an average water level in the bathtub and which detects the patient placed in the bathtub and produces an output signal for stopping the operation of the uniform current generator when the patient is not detected.

According to this construction, a safe slimming treatment is insured even when the buthtub is used by an inexperienced patient who erroneously enters the tub with with the head positioned in the downstream side of the water flow.

Preferably, the bathtub is provided therein with a backrest for supporting the patient's back in an inclined attitude with angles from about 30 to 75 degrees, the backrest being formed with a plurality of apertures for passing therethrough the water to be applied to the patient's back. This construction serves to place the patient in the bathtub in a relaxed state.

Preferably, the circulating conduit has a tapered portion positioned imediately in the upstream side of the inlet opening of the bathtub, the tapered portion having a cross-sectional area which increases toward the inlet opening. This construction can prevent the patient from receiving an excessively accelerated water current.

Further objects, features and advantages of the present invention will become apparent from the following description of the preferred embodiment of the invention as illustrated in the accompanying drawings.

DESCRIPTION OF THE PREFERRED EMBODIMENTS

FIGS. 1 to 7 show a body massaging apparatus of a circulated water current type according to a first embodiment of the present invention.

Figure 2:
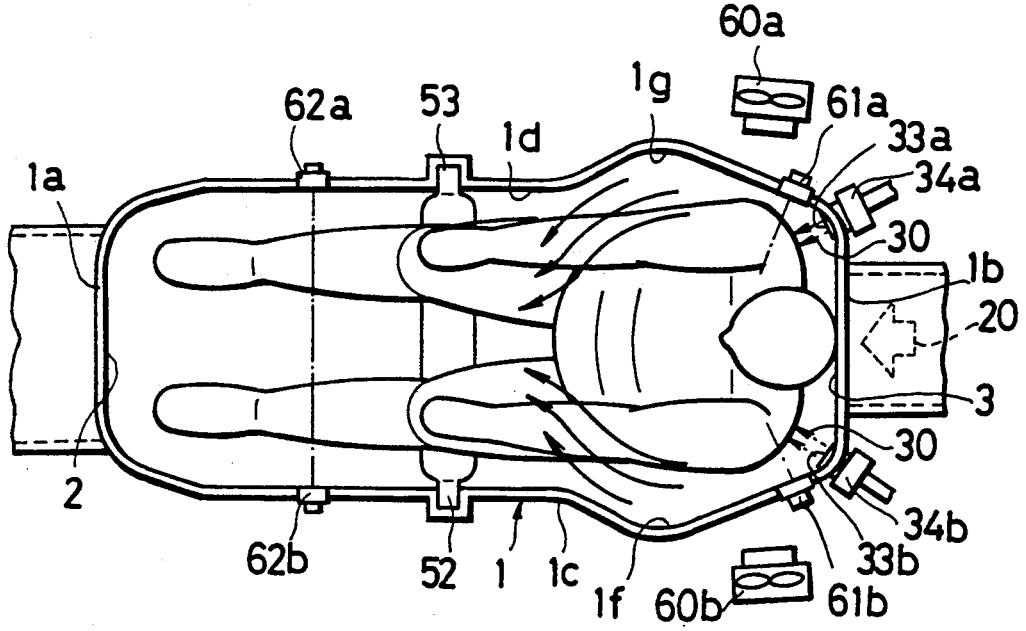
FIG. 2 is a schematic plan view of the bathtub shown in FIG. 1.
Figure 3:
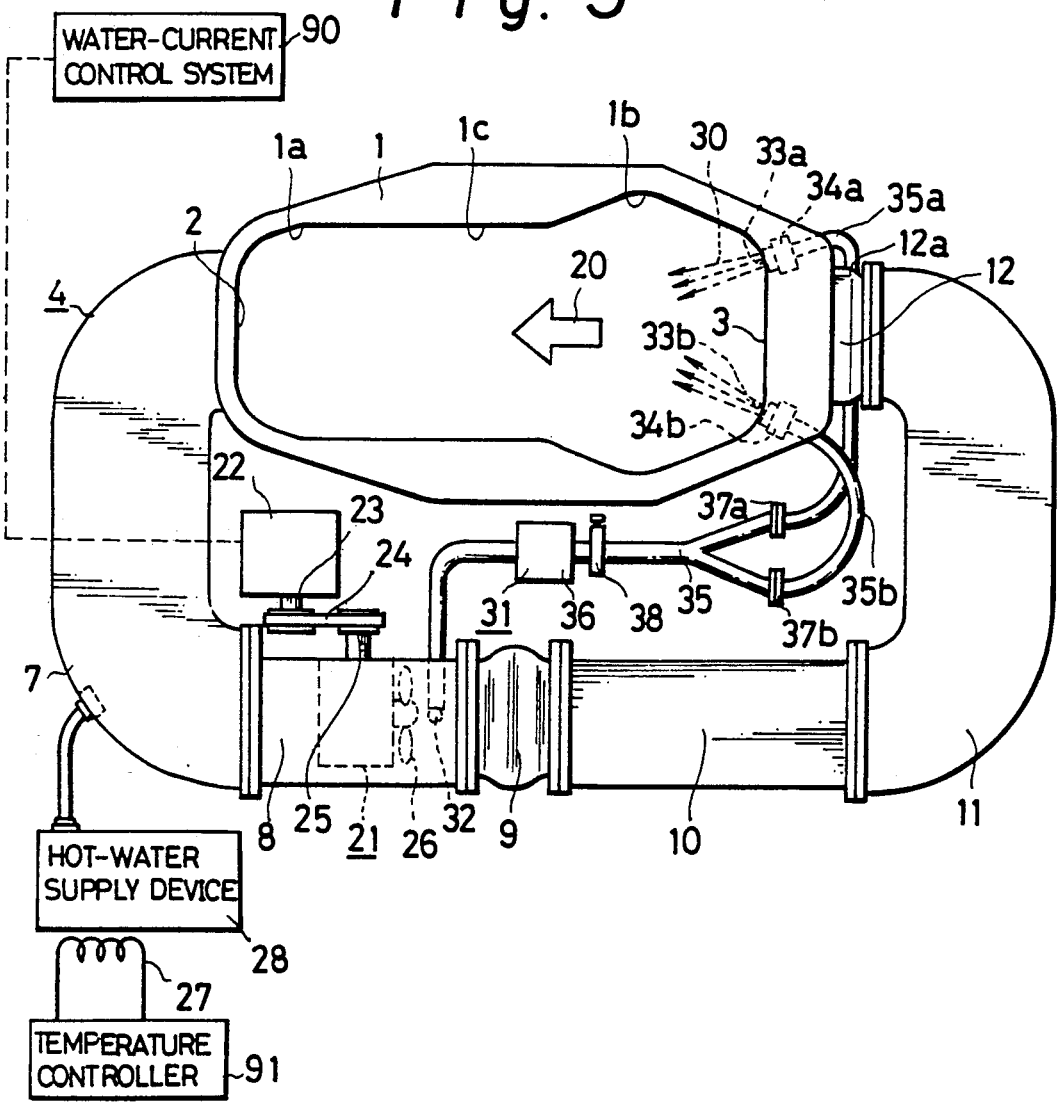
FIG. 3 is a schematic plan view of the overall structure of the first embodiment.

The overall construction of the body massaging apparatus will be explained hereinafter with reference to FIGS. 1 to 3.

Figure 1:
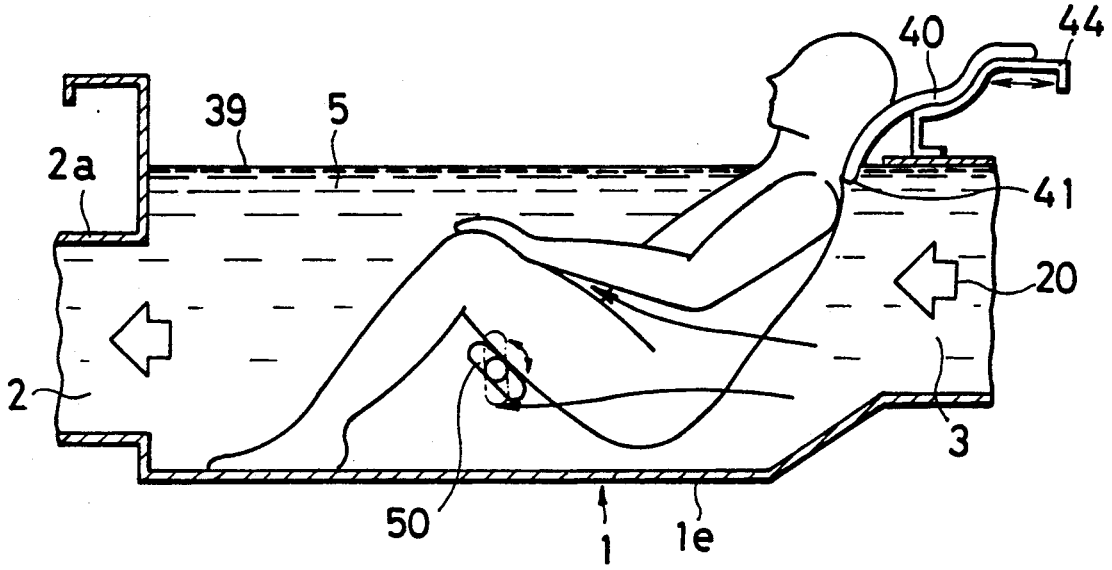
FIG. 1 is a longitudinal cross-sectional side view schemaically illustrating a bathtub of a body massaging apparatus of a circulated water current type according to a first embodiment of the present invention.

The apparatus comprises a bathtub 1 storing therein water 5 and having a size sufficient to accomodate therein at least one patient in a state close to a lying attitude, with the patient's face oriented upward, as shown in FIG. 1. The bathtub 1 is mounted on a horizontal mount base (not shown). The bathtub 1 is composed of a front and rear end walls 1*a* and 1*b*, left and right side walls 1*c* and 1*d*, and a bottom wall 1*e*. The rear end wall 1*b* of the bathtub 1 is adapted to confront the patient's back and formed with an inlet opening 3 for introducing the water into the bathtub 1, while the front end wall 1*a* for discharging the water from the bathtub 1 is formed with an outlet opening 2 positioned opposite to the inlet opening.

Connecting the outlet opening 2 with the inlet opening 3 of the bathtub 1 is a circulating conduit 4 for circulating horizontally the water through the bathtub 1, which is composed of a first curved pipe 7, a first straight pipe 8, a reinforced plastic pipe 9, a second straight pipe 10, and a second curved pipe 11 which is connected to the inlet opening 3 through a joint pipe 12. As shown in FIG. 3, the joint pipe 12 is formed with a tapered portion 12*a* having a cross-sectional area which increases toward the inlet opening 3.

Provided in the circulating conduit 4, preferably in the first straight pipe 8 thereof, is a uniform current generator 21 for producing in the bathtub 1 a uniform water current 20 which flows horizontally and straight in one direction from the inlet opening 3 toward the outlet opening 2. The uniform current generator 21 has an impeller 26 disposed in the pipe 8 and which is operatively connected to a drive motor 22 through a motor pulley 23, a belt 24 and a driven pulley 25 for rotation thereof. At least one of the curved pipes 7 and 11 may be provided therein with a corner vane (not shown) which serves to ensure the uniformity of flow of the water in the bathtub 1. The drive motor 22 is so controlled as to change suitably the flow speed or velocity and/or the flow rate of the uniform water current 20.

Connected to the circulating conduit 4, preferably to the first curved pipe 7, is a hot-water supplying device 28 having a heater 27 for heating the water 5 to be introduced into the conduit 4.

The body massaging apparatus further comprises a pulsating jet generator 31 for generating a pulsating water jet 30 which is injected into the bathtub 1 in a direction substantially the same as that of the uniform water current 20. The pulsating jet generator 31 comprises a pump 36. The suction side of the pump 36 is connected to the straight pipe 8 of the conduit 4 through a suction port 32. The discharge side of the pump 36 is connected to a pair of injection nozzles 34*a* and 34*b* having injection ports 33*a* and 33*b*, through a connecting pipe 35 having a pair of branch portions 35*a* and 35*b*. The injection nozzles 34*a* and 34*b* are disposed near the left and right sides of the inlet opening 3 of the bathtub 1, respectively, as shown in FIG. 3. Provided on the branch portions 35*a* and 35*b* are closing valves 37*a* and 37*b* which are so controlled as to open and close alternately the branch portions 35*a* and 35*b*. Provided on the connecting pipe 35 between the pump 36 and the branch portions 35*a* and 35*b* is an adjusting valve for adjusting the output pressure of the pulsating water jet injected from the pulsating jet generator 31.

A plurality of vertically spaced injection nozzles may be provided on either side of the inlet opening 3.

In this embodiment, the injection nozzles 34*a* and 34*b* are swingably attached to the bathtub 1 in the vertical and horizontal directions so that an injection angle of the pulsating water jet 30 injected from the respective injection openings 33*a* and 33*b* can be changed suitably.

Next, the construction of the bathtub 1 will be described in more detail.

Referring to FIG. 1, the outlet opening 2 has an upper end 2*a* which is so designed as to be positioned below an average water level 39 in the bathtub 1, and the cross-sectional area of the outlet opening 2 is larger than that of the inlet opening 3. The left and right side walls 1*c* and 1*d* is formed with curved portions 1*f* and 1*g*, respectively, in the vicinity of the inlet opening 3, which are outwardly convex. On the inside of the bottom wall 1*e* there may be provided a nonskid member such as rubber mat (not shown) for preventing slipping of the patient. Cosmetic or, eutrophic agents or the like, which can treat the skin of the patient, may be added into the water 5, if necessary.

The patient is placed in the bathtub 1 in which the uniform water current 20 and the pulsating water jet 30 are generated simultaneously or alternatively, in a relaxed state close to a lying attitude with the face upward, with the head placed at the upstream side of the water current. More specifically, in the illistrated embodiment, the bathtub 1 is provided therein with a pillow member 40 and a support member 50 which are provided for supporting thereon the patient in a relaxed state with the patient's back inclined at an angle within the range from about 30 to 75 degrees, as shown in FIG. 1, while the uniform water current 20, as well as the pulsating water jet 30, are applied directly and continuously on the back of the body substantially in parallel or at an acute angle to the longitudinal axis of the body.

Figure 4:
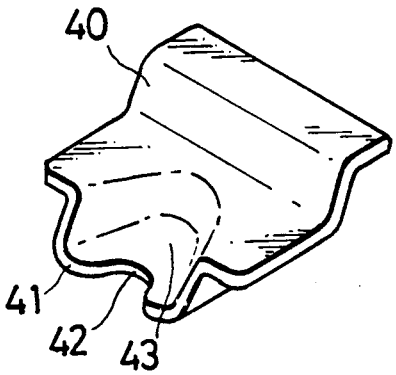
FIG. 4 is a perspective view of a pillow member of the body massaging apparatus shown in FIG. 1.

The pillow member 40, which is provided for supporting the back of the head and the neck of the patient, has an upper surface and a lower end 41 which is positioned below the average water level 39 so that the lower end 41 is always disposed in the water 5 in the bathtub. As shown in FIG. 4, the lower end 41 of the pillow member 40 is formed with a rounded notch 42 for accomodating therein the back of patient's head and neck. Further, at least a central region of the upper surface of the pillow member 40 is formed with a concave portion 43 for accomodating the back of the patient's head and neck. As shown in FIG. 1, the pillow member 40 is supported on a support 44 which is slidingly movable horizontally in forward and backward directions above the inlet opening 3 of the bathtub. Namely, the position of the pillow member 40 is adjustable horizontally in accordance with the height of the patient.

Figure 5:
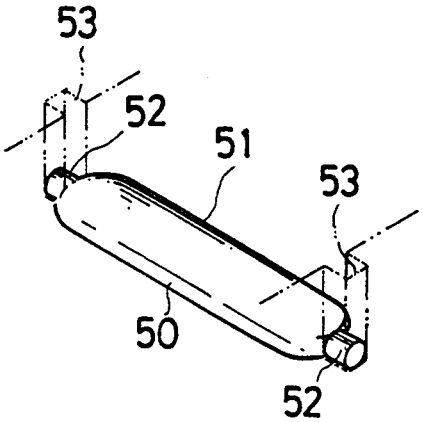
FIG. 5 is a perspective view of a support member of the body massaging apparatus shown in FIG. 1.

On the other hand, the support member 50, which is provided for supporting the lower half of the patient's body, particularly in the region between the patient's calves and hips, for example, the knees or thighs, is positioned below the average water level 39 in the bathtub. As shown in FIG. 5, the support member 50 is so arranged as to extend horizontally across the direction of flow of the water and supported at opposite ends 52 on the side walls 1*c* and 1*d* of the bathtub 1. More specifically, in this embodiment, the side walls 1*c* and 1*d* of the bathtub 1 are formed at the inside thereof with a vertically elongated grooves 53, respectively, and the opposite ends 52 of the supporting member 50 are detachably and rotatably fitted into the lower ends of the grooves 53, respectively. Further, the support member 50 is formed with a plain surface 51 for laying thereon the legs or the hips, which extends in the longitudinal direction thereof between the opposite ends 52. The support member 50 has a specific gravity which is greater than that of the water so that the support member 50 can rest at the lowest end of the grooves 53 by its own weight.

It is important that the patient supported by the pillow member 40 and the support member 50 in the above-mentioned bathtub 1, in a state close to a lying attitude, can be maintained in the most relaxed state by buoyancy. When the patient is placed in the bathtub in a state close to a standing attitude, as shown in the above references, the stimulating or massaging effects may not be sufficient, because the muscles in the body may be tensed. In contrast, by supporting the patient in the bathtub 1 in a state close to a lying attitude using the members 40 and 50, the muscles, particularly in the abdomen, are maintained in a relaxed state while being subjected to the stimulating action or massaging action of the uniform water current 20.

It is also important that the patient's body placed in the bathtub 1 be supported by the pillow member 40 and the support member 50 in such a state that the uniform water current 20 and/or the pulsating water jet 30 can be effectively applied to the patient's back. For example, in the illustrated embodiment, since the patient is supported by the members 40 and 50 only at two regions, i.e., a first region about the head and the neck and a second region about the knees. Namely, at least substantially the whole of the backbone, waist, the sides of the chest, and the sides of the abdomen of the patient with the back as the center region are exposed to the uniform water current 20, as shown in FIG. 1.

In the above references, a water current is applied to the patient's body in a direction substantially perpendicular to the longitudinal axis of the patient's body. In contrast, in the illustrated emodiment, the patient is supported in a substantially lying attitude, and the uniform water current 20 and the pilsating water jet 30 are applied to the patient's body such that the uniform water current 20 and the pilsating water jet 30 act substantially parallel to or acute angle to the longitudinal axis of the patient's body.

Furthermore, it is also important that the uniform water current 20 and the pilsating water jet 30 be applied to the patient at the patient's side supported by the members 40 and 50. Namely, the patient can receive treatment with a pleasing sensation of lying on the water current in a range of flow velocities in which the patient is not pushed along, in contrast with the conventional manner in which the patient has a sensation of opposing the water current.

Referring again to FIG. 2, the bathtub 1 is provided at the left and right side walls 1*c* and 1*d* thereof with fans 60*a* and 60*b* for sending air to region about the patient's head. Further, two photoelectric sensores 61*a* and 61*b* for detecting the upper half of the patient's body are provided on the left and light side walls 1*c* and 1*d*, respectively, at a position above the average water level 39 in the vicinity of the inlet opening 3 of the bathtub 1. A pair of photoelectric sensors 62*a* and 62*b* for detecting the upper half of the patient's body are also provided on the left and right side walls 1*c* and 1*d*, respectively, at a position above the average water level 39 in the downstream side of the water flow with respect to the center of the bathtub 1.

The operation and effect of the above-described embodiment will now be described.

The effect of the uniform water current 20 flowing in the bathtub 1, which is exerted on a human body will now be evaluated. When the average flow speed of the uniform water current 20 exceeds a certain value, vibrations occur mainly at the sides of the patient's abdomen. The greater the flow speed 3, the more those vibrations extend to the front of the abdomen, the back of the thighs and the hips.

Figure 6:
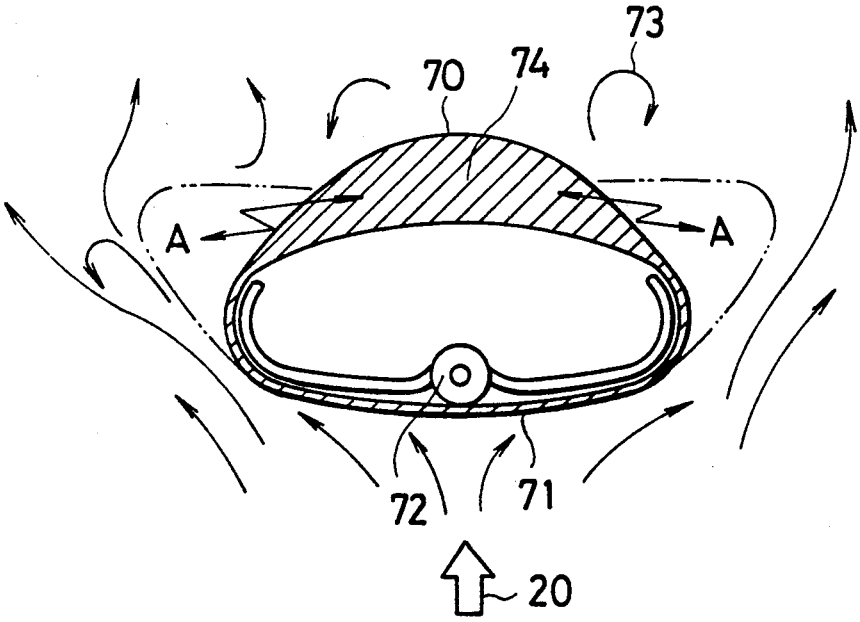
FIG. 6 is a horizontal cross-section view schematically illustrating a vibration effect applied to the body.

FIG. 6 schematically shows a transverse cross section of the patient's abdomen 70 placed in the uniform water current, in which reference numerals 71 and 72 represent the patient's back and the backbone, respectively, and a region 74 including an excessive fat is represented by oblique lines. Referring to FIG. 6, the uniform water current 20 applied to the patient's back 71 flows in a laminar flow state along the body surface from the back 71 toward the sides of the abdomen 70, and Kármán vortics 73 are produced in the water current along the body surface region from the side surfaces of the abdomen 70 to the front surface thereof, resulting in vibration at the body surface within the region 74, including any excessive fat, as shown by arrows A. Due to such vibrations, the body receives a stimulating or massaging effect which tends to activate metabolism and reduce excessive fat.

As the flow speed of the uniform current 20 increases, more self-excited vibrations occur, especially at the sides of the abdomen although such vibrations can occur elsewhere as well due to fluctuations in the flow speed. When a body (cylindrical member or human body) is placed in the uniform water current 20, the flow speed thereof increases at lateral sides of the body, which promotes separation of streams of water the lateral sides of the body, so that sufficient local changes in flow speed occur in the vicinity of points where the water streams are sevarated and vortices are generated. Accordingly, vibrations are apt to occur mainly at body surfaces with relatively soft side walls, as at the sides of the abdomen.

The flow speed of the uniform water current 20 may be adjusted suitably in accordance with the patient's physical strength, condition of the patient's health, time for the treatment, degree of fatigue, etc., as described later.

The pulsating water jet 30 will now be described. First, with only the uniform water current 20, vibration usually do not occur at the back and sides of the chest of the patient although because the patient receives the uniform water current 20 in a relaxed, supported state, the treatment can still be more effective than in the earlier-cited prior art. Therefore, in order to stimulate these reions, an additional vibrating force may be used. The patient's back, sides of the chest etc., usually have thin and relatively hard surface layers (namely, thin layers of fat), so that more focused and differently controlled energy may be required. In the particular embodiment, therefore, the pulsating water jet 30, which serves to provide an additional vibrating force, is employed in addition to the uniform water current 20.

In this way, employing the pulsating water jet 30 combined with the uniform water current 20 provides effective vibratory stimulations at the patient's back where only the uniform water current 20 is insufficient to provide the same. Accordingly, a curative effect due to balanced consumption of the fat layers can be achieved.

In the particular embodyment, the pulsating jet generator 31 can be so controlled as to inject intermitently the pulsating water jet 30 from the injecting nozzles 34*a* and 34*b*, to massage particular regions of the patient's back.

Further, in the particular embodiment, since each of the injecting nozzles 34*a* and 34*b* is capable of adjusting the injection angle thereof, it is possible to increase the massaging or beating action by concentrating the same at a given region such as the waist.

Furthermore, in the particular embodiment, since the injecting nozzles 34*a* and 34*b* can be so controlled as to inject alternately the pulsating water jets 30 from the injecting nozzles 34*a* and 34*b*, it is possible to obtain more delicate beat-massaging effect.

More than two injection nozzles, for example, three injection nozzles, may be employed. In this case, at least two injection nozzles arranged on either side of the inlet port 3 are spaced vertically to one another and can be so controlled as to inject alternately the pulsating water jets 30 from the upper and lower sides.

Since the inlet port 32 of the pulsating jet generator 31 in the illustrated embodiment is open to the interior of the first straight pipe 8 so as to introduce therein the water from the discharge side of the uniform current generator 21, hydraulic pressure in the suction side of the pump 36 is kept at a constant level, ensuring a reliable operation of a water distribution mechanism including the branch pipes 35*a* and 35*b* disposed in the down stream side of the pump 36.

Further, in the illustrated embodyment, since the pipe 35 is provided with the valve 38 for adjusting hydraulic pressure in the discharg side of the pump 36, it is posssible to apply a suitable stimulation to the patient in accordance with the patient's physical strength, condition of the patient's health, time for the treatment, degree of fatigue, etc., by adjusting suitably the strengh of the pulsating water jet 30. Similarly, the flow speed of the uniform water current 20 can be adjusted suitably by an impeller speed controller or the like.

Figure 7:
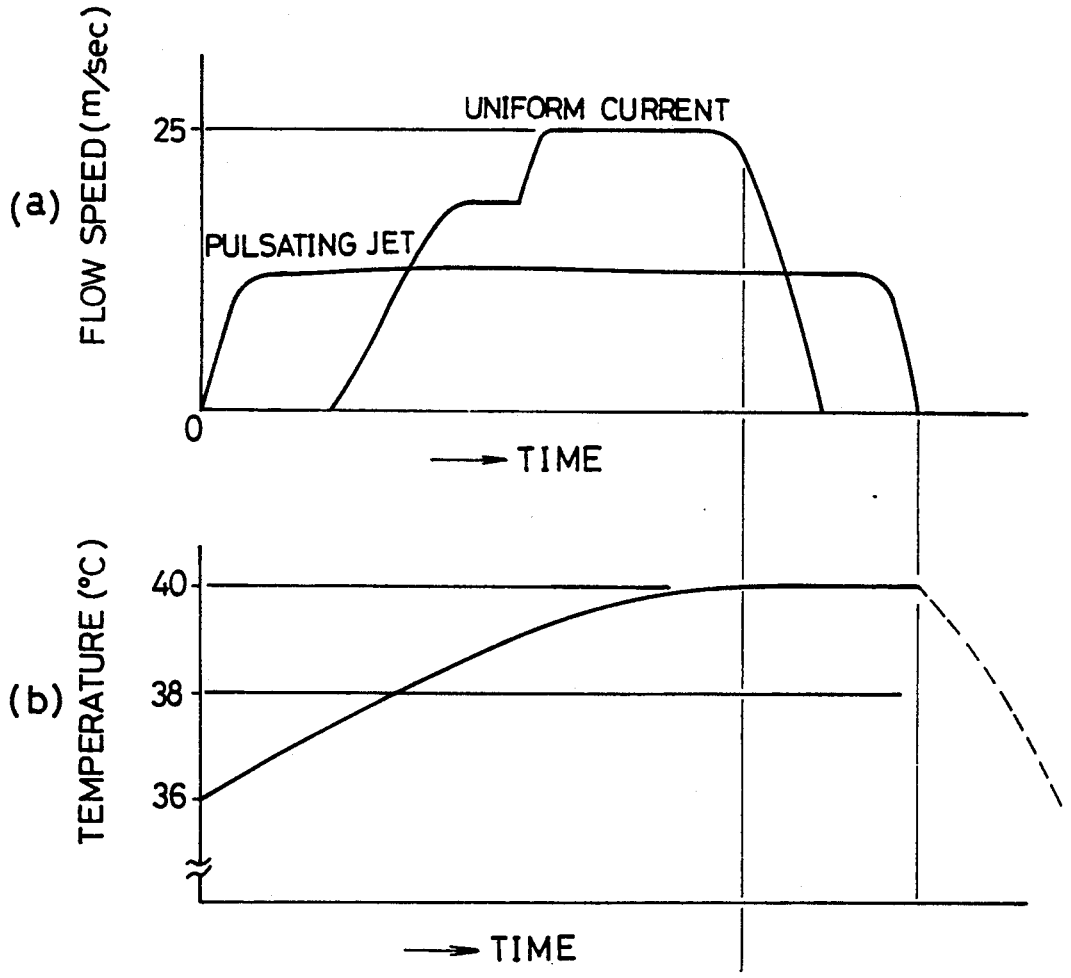
FIG. 7 is a timing chart for explaining the control of the flow speed and the temperature of the water in the bathtub.

In the illustrated embodiment, since the patient is placed in the bathtub 1 in a relaxed state, the patient can be subjected to more effective treatment as previously described. It is preferable to control the uniform water current 20 and the pulsating water jet 30 in the manner shown in FIG. 7(*a*). Referring to FIG. 7(*a*), only the pulsating water jets 30 are used initially for a first time interval (few minutes) after the operation of the body massaging apparatus has been started, in order to provide stimulating effect similar to shoulder massage on the patient's back. After the elapse of the first time interval, the uniform water current 20 is added to the pulsating water jet 30. (Alternatively, only the uniform water current 20 is used with the velocity thereof increased.) Then, only the pulsating water jets 30 are used again as a final step to provide stimulating effect similar to shoulder massage on the patient's back. In this way, the patient can be subjected to a comfortable treatment in a phisically and mentally relaxed state. Sequence controll such as shown in FIG. 7(*a*) is carried out by means of a water current contol system 90 which is schematically shown in FIG. 3.

The temperature of the water will now be considered. According to the particular embodiment, the effect due to perspiration based on the water temperature is added to that obtained by vibratory massage due to the above-described uniform water current and/or pulsating water jet applied to the patient's body regions that may have excessive fat. For the purpose of increasing perspiration only, higher temperature of the water is better. However, when the temperature of the water is higher than the temperature of the patient, the patient's temperature may increase. Further, when the temperature of the patient becomes near 40° C., physical or metal fatigue of the patient increases, causing the patient to have a disagreeable sensation such as nausea in some cases. In view of this point, lower temperature of the water is desired. However, it has been confirmed in an examination that the slimming effect decreases considerably when the temperature of the water is lower than 38° C. Accordingly, in the particular embodiment, the temperature of the water is also controlled so as to rise gradually after the operation of the body massaging apparatus has been started. FIG. 7(*b*) shows an exemplary timing chart of temperature control operation. Referring to FIG. 7(*b*), the temperature of the water is controlled so that when a massage treatment is started, the temperature of the water rises gradually from a temperature lower than 36° C. (lower than the patient's temperature), and that when the massaging treatment is almost completed, the temperature of the water reaches about 40° C. For this purpose, hot water is added into the water current circulated in the conduit 4 by means of the hot-water supply device 28. Such control of the water temperature can prevent the patient from feeling nausea or disagreeable sensation. A water heating unit for drawing water from the circulating conduit 4, heating the water drawn by the bypass passage, and then returning the water heated by the heater to the circulating conduit 4 may be used in place of the above-described hot-water supply device 28. In any case, control of the temperature of the water, such as shown in FIG. 7(*b*), is carried out by means of a water temperature controller 91 which is schematically shown in FIG. 3.

The illustrated characteristic curve of the water temperature shown in FIG. 7(*b*) is typical, and of course, the characteristic curve of the water temperature may be changed suitably in accordance with atmospheric temperature, a patient's physical strength, condition of a patient's health, time for a slimming treatment, degree of a patient's fatigue, etc..

In order to eliminate a disagreeable sensation due to a rise in the patient's temperature accompanied with a rise in the water temperaure such as described above, it is desirable to use a fan 60 to blow air toward the patient's head. Cooled air can be used, but it is also effective to use room temperature air. To prevent the patient from being exposed in an excessively cooled air, it is preferable to control the ON-OFF duty cycle of the fan 60 in accordance with an output signal from a water temperature detector (not shown).

Support of the patient will now be considered. In order to place the patient in the bathtub 1 in the most effective state, both the configuration and position of the pillow member 40 for supporting the patient's head and neck are important. Namely, when the whole of the pillow member 40 is placed above the surface of the water 5, the patient may not be fully relaxed because the patient's head and neck are too upright. Accordingly, in the illustrated embodiment, the lower end 4 of the pillow member 40 is positioned below the average water level 39 so as to keep the patient's head and neck from being too upright. If the lower end 41 of the pillow member 40 is of a straight shape throughout the width thereof, the sides of the patient's head and neck may not be adequately supported. With respect to this, since the lower end 41 of the pillow member 40 in the illustrated embodiment is formed with the rounded notch 42, the patient's head and neck can be supported in a stable state whithout moving left and right. Similarly, the concave portion 43 also serves to provide side support for the patient's head and neck. Therefore, the patient's head and neck can be supported by the pillow member 40 in more comfortable attitude. Further, the optimum position of the pillow member 40 can be different for different patients. With respect to this, since the pillow member 40 in the illustrated embodiment is slidingly displaceable, i.e., the position thereof is adjustable, it is possible and easy to support the patients in respective optimum attitudes regardless of patient size.

On the other hand, if the support member 50 for supporting the patient's legs is of a rod-like shape having a circular cross section, the patient may feel discomfort especially in the course of a long treatment, for example, a treatment of about 30 minutes, so that it may be difficult for the patient to maintain an optimun attitude. With respect to this, since the support member 50 in the illustrated embodiment is formed with the plain surface 51, as shown in FIGS. 1, 2 and 5, and rotatably supported by the bathtub 1, the backside of the patient's thighs or the like can be supported on the plain surface 51 of the support member 50 without discomfort even for a long treatment.

When the bathtub 1 is used by an inexperienced patient, the patient could get it with the patient's head at the downstream side of the water flow, or the patient's legs could be drawn into the outlet opening 2. With respect to this, in the illustrated embodiment, the photoelecric sensor 61 can detect whether or not the patient's head is placed within a proper region. If the sensor 61 does not detect the patient's head, then the drive mechamisms, particularly the drive motor 22 for the uniform current generator 21 are turned off on the basis of an output signal of the sensor 61. Accordingly, a safe treatment is ensured. Further, when any part of the patient is detected by the sensors **62*a* and 62*b* which is positioned in the downstream side of the center of the bathtub 1 (above the average water level), the drive motor 22 for the uniform current generator 21 is turned off on the basis of an output signal of the sensors 62*a* and 62*b*. (When the position of the patient is proper, the sensors 62*a* and 62*b* can not detect any part of the patient, as apparent from FIG. 1**.) Accordingly, a safe treatment is ensured.

The construction of the bathtub 1 will now be considered in detail. If the upper end **2*a* of the outlet opening 2 is set to a position having a hight which is substantially the same as that of the upper end of the inlet opening 3 and that of the average water level 39, air would be drawn into the conduit 4 through the outlet opening 2 due to a lowering of the water level. As a result, the load of the water current generating means would fluctuate irregularly, causing damage to the drive means (the motor 22, the impeller 26, etc.) and the flexible pipe 9. Further, an irregular water current due to mixing of air causes the water level 39 to fluctuate in a seesaw state, giving the patient a disagreeable sensation. With respect to this, in the illustrated embodiment, since the upper end 2*a* of the outlet opening 2 is set to a position which is lower than the average water level 39, it is possible to prevent air from being drawn into the conduit 4 through the outlet opening 2**, preventing the above-mentioned consequences.

On the other hand, if the outlet opening 2 positioned in the downstream side of the water current has a cross-sectional area which is smaller than that of the inlet opening 3 which is positioned in the upstream side of the water current, negative pressure would occur in the outlet opening 2 due to acceleration of the water current, causing the patient's legs to be drawn thereinto. With respect to this, in the illustrated embodiment, the outlet opening 2 has a cross-sectional area which is larger than that of the inlet opening 3, and negative pressure does not occur in the outlet opening 2. Accordingly, the patient can receive safe treatment. Further, in the illustrated embodiment, since the connecting pipe 12 positioned in the upstream side of the inlet opening 3 is formed with the tapered portion **12*a* having a cross-sectional area which decreases toward the curved pipe 11 positioned in the upstream side of the connecting pipe 12, the water current is not accelerated excessively in the vicinity of the inlet opening 3**.

Furthermore, in the illustrated embodiment, since the side walls **1*c* and 1*d* of the bathtub 1 are formed in the vicinity of the inlet opening 3 with curved portions 1*f* and 1*g*, respectively, which are convex outwardly, it is possible to increase the velocity of flow of the water passing between the side walls and the patient's body. Accordingly, a vibratory massaging effect produced by the water current and applied to the region 74**, where there may be excessive fat, can be increased.

Although in the illustrated embodiment, a straight water current passing through the bathtub is used as the uniform water current 20, the uniform water current 20 may be formed of a circulating current which circulates in the bathtub 1.

Figure 8:
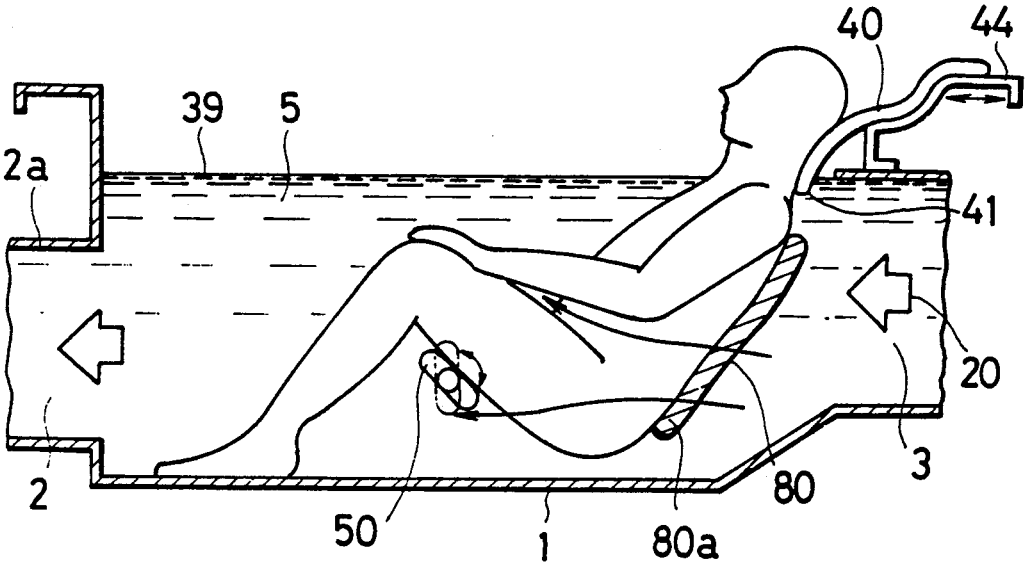
FIG. 8 is a longitudinal cross-sectional side view schemaically illustrating a bathtub of a body massaging apparatus of a circulated water current type according to a second embodiment of the present invention.

FIG. 8 shows a second embodiment of the present invention. In FIG. 8, the constituent elements substantially the same as those of the above-described first embodiment are denoted by the same reference numerals. In the second embodiment, the bathtub 1 is provided therein with a backrest plate 80 for supporting the back of the patient's body in an inclined attitude with angles from about 30 to 75 degrees. The backrest plate 80 is formed with a plurality of apertures **80*a*** for passing therethrough the water to be applied to the back of the patient's body.

While the invention has been described in conjunction with specific embodiments thereof, it is evident that many alternatives, modifications, and variations will be apparent to those skilled in the art in light of the foregoing description. Accordingly, it is intended to include all such alternatives, modifications and variations as fall within the spirit and scope of the appended claims.

What is claimed is:

1. A body massaging apparatus of a circulated water current type comprising:

a bathtub for storing therein water in which a patient's body can be positioned in reclining attitude, said bathtub having an inlet for introducing water into the bathtub and an outlet for discharging water from the bathtub, said inlet being positioned to confront the upper part of the patient's body and said outlet being positioned to confront the lower part of the patient's body;

a circulating conduit disposed outside of the bathtub and connecting said inlet and outlet to circulate water from the outlet into the inlet;

a uniform current flow generator which generates a uniform current flow flowing generally unidirectionally from said inlet through said bathtub, said uniform current flow being applied directly to a patient's body in said bathtub substantially along or at an acute angle to the longitudinal axis of the bathtub;

a pulsating partial jet generator generating in said uniform current a partial jet to produce vortices with sufficient energy and wave parameters to cause vibrations at predetermined regions of the patient's body, said partial jet being a pulsating jet flow repeating on and off with a predetermined time period; and a controller controlling said uniform current generator and said partial jet generator to first apply to the patient's body only said pulsating partial jet during a first predetermined time interval after starting of an operation of said body massaging apparatus, then to apply to the patient's body said uniform current as well as said pulsating partial jet during a second predetermined time interval after the elapse of said first determined time interval, and then to apply to the patient's body again only said pulsating partial jet during a third predetermined time interval after the elapse of said second determined time interval.

2. A body massaging apparatus of a circulated water current type comprising:

a bathtub into which a patient's body can be positioned;

means for generating a uniform current which flows in one direction through said bathtub and is applied directly to a patient's body in said bathtub;

means for generating in said uniform current a partial jet as to produce vortices with sufficient energy and wave parameters to cause vibrations at predetermined regions of the patient's body, said partial jet being a pulsating jet flow repeating on and off with a predetermined time period;

means for controlling said uniform current generating means and said pulsating partial jet generating means respectively so as to first apply to the patient's body only said pulsating partial jet during a first predetermined time interval after starting of an operation of said body massaging apparatus, then to apply to the patient's body said uniform current as well as said pulsating partial jet during a second predetermined time interval after the elapse of said first determined time interval, and then to apply to the patient's body again only said pulsating partial jet during a third predetermined time interval after the elapse of said second determined time interval; and at least one support member provided on said bathtub for supporting thereon the patient's legs or hips, positioned below an average water level in said bathtub, extending horizontally across the direction of flow of the water, and supported at opposite ends thereof on said bathtub for rotation about the longitudinal axis of said support member.

3. A body massaging apparatus according to claim 2, wherein said bathtub has opposite side walls extending along the direction of flow of the water in said bathtub and being formed at the insides thereof with vertically elongated grooves respectively, said support member having a specific gravity which is greater than that of the water and being detachably, slidably and rotatably engaged at the respective opposite ends thereof with said vertically elongated grooves.

4. A body massaging apparatus according to claim 3, wherein said support member is formed with a substantially flat surface extending in the longitudinal direction thereof, for supporting thereon the legs or the hips of the patient.

5. A body massaging apparatus of a circulated water current type comprising:

a bathtub for storing water therein into which a patient's body can be positioned in a reclining position, with the long axis of the patient's body being generally along the long axis of the bathtub, said bathtub having an inlet for introducing water into the bathtub and an outlet for discharging water from the bathtub;

a circulating conduit positioned outside the bathtub and connecting the inlet and outlet to circulate water from the outlet to the inlet;

a uniform current flow generator generating a uniform current which flows in one direction through said bathtub and is applied directly to a patient's body in said bathtub;

a pulsating partial jet generator generating in said uniform current a partial jet to produce vortices with sufficient energy and wave parameters to cause vibrations at predetermined regions of the patient's body, said partial jet being a pulsating jet flow repeating on and off with a predetermined time period;

a controller controlling said uniform current flow generator and said pulsating partial jet generator to apply to said body first only said pulsating partial jet during a first predetermined time interval after starting of an operation of said body massaging apparatus, then to apply to the patient's body said uniform current in addition to said pulsating partial jet during a second predetermined time interval after the elapse of said first determined time interval, and then to apply to said body again only said pulsating partial jet during a third predetermined time interval after the elapse of said second determined time interval; and a temperature controller controlling the temperature of the water in said bathtub so as to set said water temperature to a first predetermined level lower than the temperature of the patient's body during a first predetermined time interval after starting of an operation of said body massaging apparatus, then to raise gradually the temperature of said water to a second predetermined level higher than the temperature of the patient's body.

6. A body massaging apparatus according to claim 5, wherein said first predetermined temperature is lower than 36° C.

7. A body massaging apparatus according to claim 5, wherein said second predetermined temperature is 38° C. to 40° C.

8. Apparatus comprising:

an elongated tub having a water inlet and a water outlet, said tub containing water in which a patient's body can be immersed with the long axis of the body extending generally along the length of the tub and with the patient's head adjacent the water inlet and the patient's feet adjacent the water outlet;

a circulating conduit extending outside the tub and connecting the inlet and outlet to circulate water from the outlet into the inlet;

main flow means for selectively introducing into said tub, through said water inlet, a substantially uniform water flow which substantially surrounds the patient while flowing through the tub and generates vortices at least at the abdominal area of the patient and exits the tub through said water outlet;

jet flow means for selectively introducing into said tub at least one pulsed flow of water impinging on at least one selected area of the patient's body; and control means controlling the main flow means and the jet flow means to turn on and turn off said uniform water flow and said pulsed flow at selected times to subject the patient to the pulsed flow during one time interval and to at least the uniform flow during another time interval.

9. Apparatus as in claim 8 in which the control means includes means for controlling the main flow means and the jet flow means to subject the patient first to the pulsed flow alone, then to the concurrent action of the uniform flow and the pulsed flow of water.

10. Apparatus as in claim 9 in which the control means includes means for controlling the main flow means and the jet flow means to subject the patient first to the pulsed flow alone, then to the concurrent action of the uniform flow and the pulsed flow, and then to the pulsed flow alone.

11. Apparatus as in claim 8 including temperature control means which controls the temperature of the water in at least one of said flows to gradually increase the water temperature during the action of said at least one flow from a starting temperature which is lower than the patient's temperature to an end temperature which is higher than the patient's temperature.

12. Apparatus as in claim 8 in which said end temperature is about 38° C. to 40° C.

* * * * *